US008707927B2

(12) United States Patent
Hazelton

(10) Patent No.: US 8,707,927 B2
(45) Date of Patent: Apr. 29, 2014

(54) OIL SQUIRTER

(75) Inventor: Gary J. Hazelton, White Lake, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 188 days.

(21) Appl. No.: 13/186,860

(22) Filed: Jul. 20, 2011

(65) Prior Publication Data

US 2013/0019834 A1 Jan. 24, 2013

(51) Int. Cl.

| | |
|---|---|
| ***F01M 11/03*** | (2006.01) |
| ***F01L 5/04*** | (2006.01) |
| ***F01M 5/00*** | (2006.01) |
| ***F01M 3/04*** | (2006.01) |
| ***F01M 11/10*** | (2006.01) |
| ***F02B 61/04*** | (2006.01) |

(52) U.S. Cl.

USPC ..... 123/196 R; 123/196 A; 123/196 V; 123/196 AB; 123/196 M; 123/196 S; 123/196 W

(58) Field of Classification Search

USPC ..... 123/196 R, 196 A, 196 CP, 196 AB, 123/196 M, 196 S, 196 V, 196 W

See application file for complete search history.

(56) References Cited

U.S. PATENT DOCUMENTS

| | | | | |
|---|---|---|---|---|
| 2,765,784 | A * | 10/1956 | Harvey | 123/196 M |
| 3,313,284 | A * | 4/1967 | Polidan | 123/196 R |
| 4,472,112 | A * | 9/1984 | Unger | 417/311 |
| 4,942,855 | A * | 7/1990 | Muto | 123/90.33 |
| 5,375,573 | A * | 12/1994 | Bowman | 123/196 R |
| 5,819,692 | A * | 10/1998 | Schafer | 123/41.35 |
| 6,866,011 | B1 * | 3/2005 | Beardmore | 123/41.35 |
| 2003/0121490 | A1 * | 7/2003 | Hori et al. | 123/196 R |
| 2006/0243226 | A1 * | 11/2006 | Bontaz et al. | 123/41.35 |
| 2008/0066712 | A1 * | 3/2008 | Aamand | 123/196 M |
| 2009/0107602 | A1 * | 4/2009 | Kabakov | 152/427 |
| 2009/0229561 | A1 * | 9/2009 | Yamashita et al. | 123/196 R |
| 2010/0031917 | A1 * | 2/2010 | Abe | 123/197.2 |
| 2010/0037839 | A1 * | 2/2010 | Aixala | 123/41.35 |
| 2010/0139609 | A1 * | 6/2010 | Ahn | 123/196 R |

FOREIGN PATENT DOCUMENTS

| | | | |
|---|---|---|---|
| GB | 2431219 | A * | 4/2007 |

* cited by examiner

*Primary Examiner* — Lindsay Low
*Assistant Examiner* — Charles Brauch
(74) *Attorney, Agent, or Firm* — Quinn Law Group, PLLC

(57) ABSTRACT

An oil squirter includes a housing in fluid communication with a source of oil pressure, a first nozzle in fluid communication with the housing, and a second nozzle in fluid communication with the housing. The oil squirter also includes a mechanism arranged within the housing and configured to open the first nozzle and close the second nozzle when the oil pressure is below a threshold value. The mechanism is also configured to open the second nozzle and close the first nozzle when the oil pressure is at or above the threshold value. An engine having a cylinder defined by a cylinder bore, a piston configured to reciprocate within the cylinder bore, and the oil squirter, along with a vehicle having such an engine, is also disclosed. In the engine, the first nozzle sprays oil onto the cylinder bore and the second nozzle sprays oil at the underside of the piston.

17 Claims, 3 Drawing Sheets

OIL SQUIRTER

TECHNICAL FIELD

The present disclosure relates to an oil squirter.

BACKGROUND

Internal combustion (IC) engines, such as those used in motor vehicles, typically generate heat energy as a by-product of generating power. Generally, such engines are also cooled in order to maintain their operating temperature in a particular range and ensure the engine's efficient and reliable performance for propelling the subject motor vehicle.

In a majority of motor vehicles, IC engines are cooled by a circulating fluid, such as a specially formulated chemical compound mixed with water. Additionally, such engines are lubricated and cooled by oils that are generally derived from petroleum-based and non-petroleum synthesized chemical compounds.

Under extreme operating conditions, IC engines generate elevated amounts of heat energy within their combustion chambers. Such heat energy usually affects the entire engine structure, but is initially absorbed by the engine's pistons. In order to permit the pistons to reliably withstand elevated thermal stresses, IC engines are often equipped with oil squirters to cool the pistons.

SUMMARY

An oil squirter includes a housing in fluid communication with a source of oil pressure, a first nozzle in fluid communication with the housing, and a second nozzle in fluid communication with the housing. The oil squirter also includes a mechanism arranged within the housing and configured to open the first nozzle and close the second nozzle when the oil pressure is below a threshold value. The mechanism is also configured to open the second nozzle and close the first nozzle when the oil pressure is at or above the threshold value.

The mechanism may include a piston configured to remain in a first position when the oil pressure is below the threshold value and be shifted by the oil pressure to a second position when the oil pressure is at or above the threshold value. The piston may define a fluid passage configured to supply oil to the first nozzle when the piston is in the first position and be shut off when the piston is in the second position.

The mechanism may also include a spring configured to preload the piston to the first position when the oil pressure is below the threshold value and permit the piston to be shifted to the second position when the oil pressure is at or above the threshold value.

The mechanism may additionally include a stopper configured to substantially block the passage when the piston is shifted to the second position. The stopper may be integral with the housing.

The fluid passage may include a first end and second end, such that the first end is exposed to the first nozzle, and the second end is exposed to the source of oil pressure.

The fluid passage may provide a first oil path in fluid communication with the first nozzle and the housing may provide a second oil path in fluid communication with the second nozzle.

An engine is disclosed having a cylinder defined by a cylinder bore, a piston configured to reciprocate within the cylinder bore, and the oil squirter. In the engine, the oil squirter's first nozzle sprays oil onto the cylinder bore and the second nozzle sprays oil at the underside of the piston. A vehicle having such an engine is also disclosed.

The above features and advantages and other features and advantages of the present invention are readily apparent from the following detailed description of the best modes for carrying out the invention when taken in connection with the accompanying drawings.

DETAILED DESCRIPTION

Figure 1:
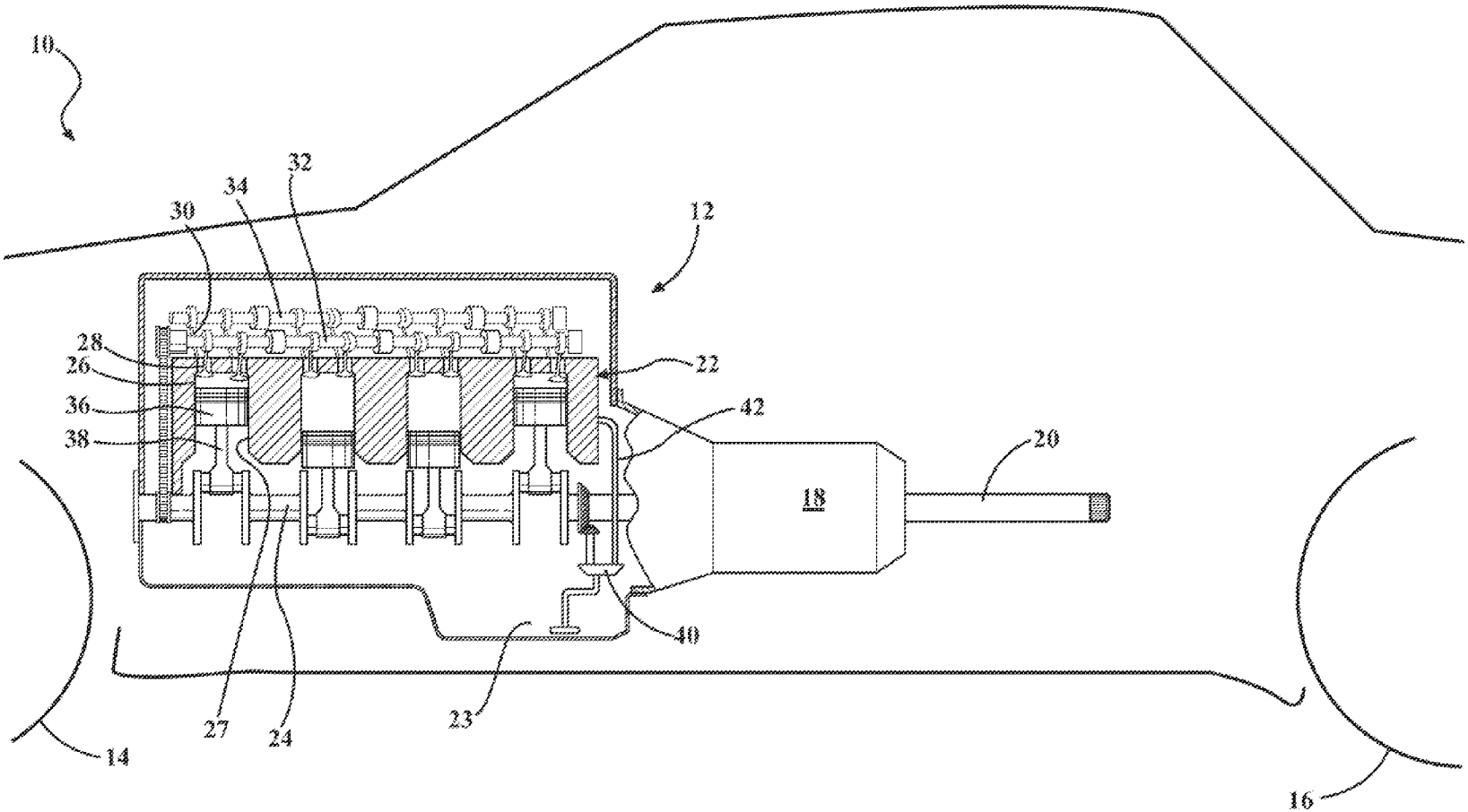
FIG. 1 is a schematic illustration of a motor vehicle including an internal combustion engine employing an oil pump used to supply an oil squirter.

Referring to the drawings, wherein like reference numbers refer to like components, FIG. 1 shows a schematic view of a motor vehicle 10. The vehicle 10 incorporates a powertrain that includes an internal combustion (IC) engine 12, such as a spark or a compression ignition type, adapted for driving wheels 14 and/or wheels 16 to propel the vehicle. The engine 12 applies its torque to the driven wheels 14 and/or 16 through a transmission 18 and via a drive or a propeller shaft 20.

The engine 12 includes a cylinder block 22 and an oil pan or sump 23. The sump 23 is attached to the cylinder block 22 for holding a body of oil. The cylinder block 22 houses a crankshaft 24 and cylinders 26. Each cylinder 26 is defined by a cylinder bore 27, and is provided with intake valves 28 and exhaust valves 30 that may be actuated by respective intake and exhaust camshafts 32, 34, as shown in FIG. 1. The intake valves 28 are configured to control supply of air or of air and fuel into the respective cylinder 26, while the exhaust valves 30 are configured to control the removal of post combustion exhaust gas from the respective cylinder. Each cylinder 26 also includes a piston 36 and a connecting rod 38. The pistons 36 are configured to reciprocate under the force of combustion inside their respective cylinder bores 27, and thereby rotate the crankshaft 24 via the connecting rods 38.

The crankshaft 24, camshafts 32, 34, connecting rods 38 and various other rotating or otherwise frequently moving components of the engine 12 are supported by specifically configured bearings (not shown). Typically, such bearings rely on a film of oil established between a surface of the bearing and the supported component to create a reliable low friction interface. Typically, the oil used in internal combustion engines is a specially formulated fluid that is derived from petroleum-based and non-petroleum chemical compounds. Such oil is mainly blended by using base oil composed of hydrocarbons and other chemical additives for a specific engine application.

The engine 12 also includes an oil pump 40 configured to draw oil from the sump 23, and then pressurize and supply the oil to a main oil gallery 42. The gallery 42, in turn, distributes the pressurized oil to the engine bearings of the crankshaft 24, camshafts 32, 34, connecting rods 38, and to other components that rely on the oil for lubrication, actuation, and/or cooling. Because the engine 12 requires a greater pressure and volume of oil at higher engine speeds and combustion pressures, the pump 40 is configured to generate a progressive increase in the amount of oil pressure as the speed of the engine 12 rises. The pump 40 may be driven mechanically by the engine 12, such as by the one of the camshafts 32, 34 or the crankshaft 24, or be operated electrically.

Figure 2:
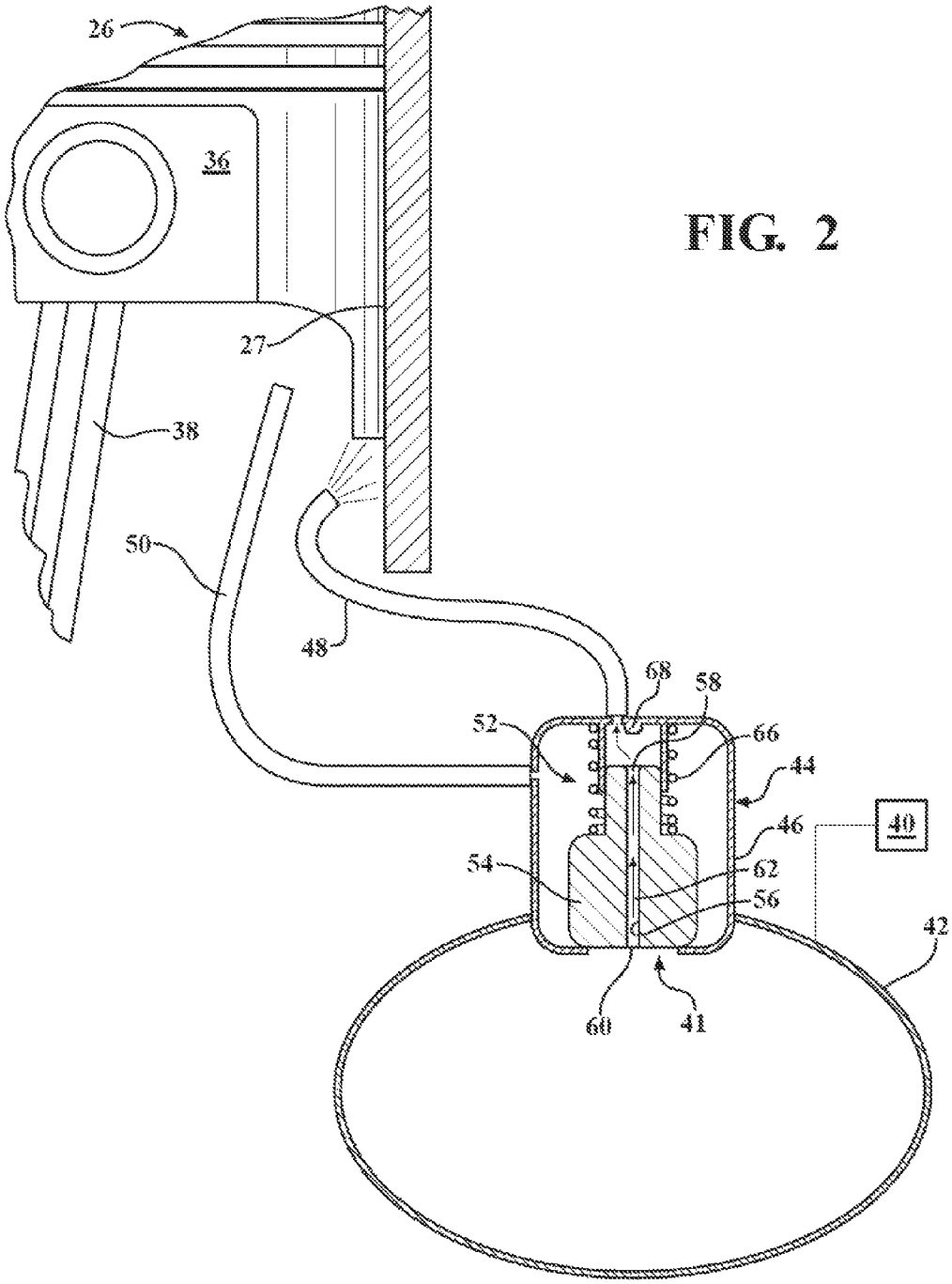
FIG. 2 is a schematic cross-sectional illustration of the oil squirter shown in FIG. 1, with the oil squirter depicted operating in a first mode.
Figure 3:
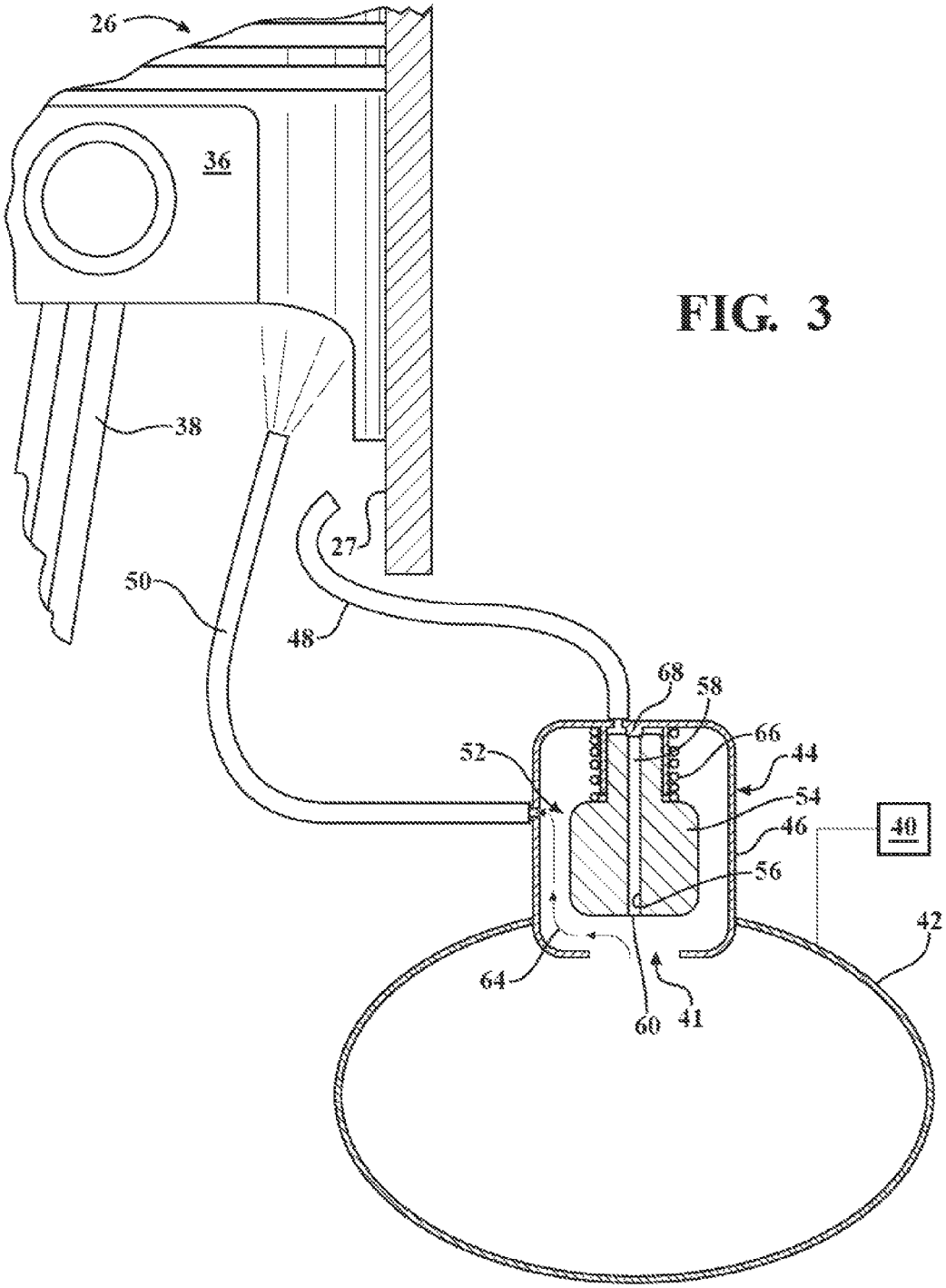
FIG. 3 is a schematic cross-sectional illustration of the oil squirter shown in FIG. 1, with the oil squirter depicted operating in a second mode.

As shown in FIGS. 2-3, the engine 12 also includes oil squirters 44. The oil squirters 44 are arranged on the cylinder block 22, with one oil squirter positioned at each respective cylinder 26 underneath a respective piston 36 for selectively supplying a jet of oil to the underside of the piston and to the respective cylinder bore 27. The oil squirters 44 are thereby employed to selectively reduce the thermal stress experienced by the pistons 36 as a result of combustion during operation of engine 10 and lubricate the cylinder bores 27 by generating a film of oil thereon. Although a single oil squirter 44 is shown at each cylinder 26 location, any quantity of oil squirters 44 may be used at each cylinder in other possible embodiments. The oil pressure generated by the pump 40 is sufficient for each oil squirter 44 to establish the jet of oil that targets the underside of the respective piston 36 and cylinder bore 27.

Each oil squirter 44 includes a housing 46. The housing 46 is in fluid communication with the pump 40 via an opening 41 to the gallery 42. Each oil squirter 44 also includes a first nozzle 48 that is in fluid communication with the housing 46 and is configured to spray oil onto the respective cylinder bore 27. Each oil squirter 44 additionally includes a second nozzle 50 that is in fluid communication with the housing 46 and is configured to spray oil at the underside of the respective piston 36. Furthermore, each oil squirter 44 includes a mechanism 52. The mechanism 52 is arranged within the housing 46 and is configured to open the first nozzle 48 and close the second nozzle 50 when the oil pressure within the gallery 42 is below a threshold value. The mechanism 52 is additionally configured to open the second nozzle 50 and close the first nozzle 48 when the oil pressure within the gallery 42 is at or above the threshold value. The threshold value of oil pressure may be set, for example, at 20 Psi (138 KPa).

The threshold value of the oil pressure may be established empirically during development and testing of the engine 12. Accordingly, the threshold value may be set based on the engine speed below which it is desirable to reduce audible noise generated due to clearance between the bore 27 and the piston 36, as well as enhance lubrication there between. At lower to medium engine speeds, such as below 3,000 RPM, because the overall noise generated by the engine 12 is lower than at higher engine speeds and loads, the noise generated due to the clearance between the piston 36 and the bore 27 may be objectionable. Therefore, at lower to medium engine speeds the first nozzle 48 is used to spray oil onto the respective cylinder bore 27 in order to take up the clearance between the piston 36 and the cylinder bore.

At higher engine speeds, such as at and above 3,000 RPM, the noise due to clearance between the bore 27 and the piston 36 may be overshadowed by the increase in the overall engine noise. Furthermore, the increased thermal energy being absorbed by the pistons 36 at higher engine speeds may be detrimental to the engine's reliability. Accordingly, at such higher engine speed, cooling of the pistons 36 may take precedence over engine noise concerns. Therefore, at higher engine speeds the first nozzle 48 is used to cool the underside of the respective piston 36.

FIG. 2 depicts the oil squirter 44 operating in a first mode where the first nozzle 48 sprays oil onto the respective cylinder bore 27, while FIG. 3 depicts the oil squirter operating in a second mode where the second nozzle 50 sprays oil at the underside of the respective piston 36. As shown in FIGS. 2 and 3, the mechanism 52 includes a piston 54 configured to remain in a first position (shown in FIG. 2) when the oil pressure is below the threshold value and be shifted by the oil pressure to a second position when the oil pressure is at or above the threshold value. The piston 54 defines a fluid passage 56.

The fluid passage 56 includes a first end 58 and second end 60. The first end 58 is exposed to the first nozzle 48 and the second end 60 is exposed to the pump 40 via the gallery 42. The fluid passage 56 is thereby configured to provide a first oil path 62 that is in fluid communication with the first nozzle 48 when the oil pressure is below the threshold value. Accordingly, the fluid passage 56 is configured to supply pressurized oil to the first nozzle 48 when the piston 54 is in the first position and be shut off when the piston is in the second position. The housing 46, for its part, provides a second oil path 64 that is in fluid communication with the second nozzle 50 when the oil pressure is at or above the threshold value. As shown in FIGS. 2 and 3, the second oil path 64 is generated through the interior of the housing 46 when the piston 54 shifts to the second position and thereby uncovers the opening 41. Accordingly, the second oil path 64 is configured to supply pressurized oil to the second nozzle 50 when the piston 54 resides in the second position.

The mechanism 52 also includes a spring 66. The spring 66 is configured to preload the piston 54 to the first position and substantially close off the opening 41 when the oil pressure in the gallery 42 is below the threshold value. The spring 62 is additionally configured to permit the piston 54 to be shifted to the second position when the oil pressure in the gallery 42 is at or above the threshold value. To achieve such a response of the piston 54, the spring constant "K" of the spring 66 is selected according to the area of the piston 54 exposed to the oil pressure in the gallery 42. Therefore, the spring constant "K" of the spring 66 along with the area of the piston 54 ensure that the opening 41 remains closed by the piston 54 up to the threshold value of the oil pressure and be opened when the oil pressure reaches the threshold value. The mechanism 52 additionally includes a stopper 68. The stopper 68 is configured to substantially block the fluid passage 56 and permit the pressurized oil from the gallery 42 to be directed to the second oil path 64 when the piston 54 is shifted to the second position. As shown in FIGS. 2 and 3, the stopper 68 may be formed integral with the housing 46.

Overall, as disclosed, the oil squirter 44 is a dual mode mechanism. In its first mode of operation, the oil squirter 44 provides the ability to take up clearances between the respective cylinder bore 27 and piston 36 to reduce engine noise at lower engine speeds and increase lubrication of the piston and the cylinder bore. Additionally, in its second mode of operation, the oil squirter 44 provides the ability to also cool the underside of the respective piston 36 at higher engine speeds to enhance reliability of the engine 12.

While the best modes for carrying out the invention have been described in detail, those familiar with the art to which this invention relates will recognize various alternative designs and embodiments for practicing the invention within the scope of the appended claims.

The invention claimed is:

1. An oil squirter comprising:

a housing in fluid communication with a source of oil pressure;

a first nozzle in fluid communication with the housing;

a second nozzle is fluid communication with the housing; and a mechanism arranged within the housing and having an internal piston that defines a fluid passage and is configured to open the first nozzle and close the second nozzle when the oil pressure is below a threshold value and open the second nozzle and close the first nozzle when the oil pressure is at or above the threshold value;

wherein:

the internal piston remains in a first position when the oil pressure is below the threshold value and is shifted by the oil pressure to a second position when the oil pressure is at or above the threshold value;

when the internal piston is in the first position, the fluid passage supplies oil to the first nozzle; and when the internal piston is in the second position, the fluid passage is blocked off and oil is directed around the internal piston to the second nozzle.

2. The oil squirter according to claim 1, wherein the mechanism additionally includes a spring configured to preload the internal piston to the first position when the oil pressure is below the threshold value and permit internal piston to be shifted to the second position when the oil pressure is at or above the threshold value.

3. The oil squirter according to claim 2, wherein the mechanism additionally includes a stopper configured to substantially block the passage when the internal piston is shifted to the second position.

4. The oil squirter according to claim 3, wherein the stopper is formed integrally with the housing.

5. The oil squirter according to claim 4, wherein the fluid passage includes a first end and second end, and wherein the first end is exposed to the first nozzle, and the second end is exposed to the source of oil pressure.

6. The oil squirter according to claim 5, wherein the fluid passage provides a first oil path in fluid communication with the first nozzle and the housing provides a second oil path in fluid communication with the second nozzle.

7. The oil squirter according to claim 1, wherein the oil squirter is arranged in an internal combustion engine having a cylinder defined by a cylinder bore and a piston configured to reciprocate within the cylinder bore, and wherein the first nozzle is configured to spray oil onto the cylinder bore, and the second nozzle is configured to spray oil at the underside of the piston.

8. An internal combustion engine comprising: a cylinder defined by a cylinder bore; a piston configured to reciprocate within the cylinder bore; an oil pump configured to generate oil pressure; and an oil squirter having: a housing in fluid communication with the oil pump; a first nozzle in fluid communication with the housing and configured to spray oil onto the cylinder bore; a second nozzle in fluid communication with the housing and configured to spray oil at the underside of the piston; and a mechanism arranged within the housing and having an internal piston that defines a fluid passage and is configured to open the first nozzle and close the second nozzle when the oil pressure is below a threshold value and open the second nozzle and close the first nozzle when the oil pressure is at or above the threshold value; wherein: the internal piston remains in a first position when the oil pressure is below the threshold value and is shifted by the oil pressure to a second position when the oil pressure is at or above the threshold value; when the internal piston is in the first position, the fluid passage supplies oil to the first nozzle; and when the internal piston is in the second position, the fluid passage is blocked off and oil is directed around the internal piston to the second nozzle.

9. The engine according to claim 8, wherein the mechanism additionally includes a spring configured to preload the internal piston to the first position when the oil pressure is below the threshold value and permit the internal piston to be shifted to the second position when the oil is at or above the threshold value.

10. The engine according to claim 9, wherein the mechanism additionally includes a stopper configured to substantially block the passage when the internal piston is shifted to the second position.

11. The engine according to claim 10, wherein the stopper is formed integrally with the housing.

12. A vehicle comprising: an internal combustion engine configured to propel the vehicle, the engine including a cylinder defined by a cylinder bore, a piston configured to reciprocate within the cylinder bore, and oil pump configured to general oil pressure; and an oil squirter having: a housing in fluid communication with the oil pump; a first nozzle in fluid communication with the housing and configured to spray oil onto the cylinder bore; a second nozzle in fluid communication with the housing and configured to spray oil at the underside of the piston; and a mechanism arranged within the housing and having an internal piston that defines a fluid passage and is configured to open the first nozzle and close the second nozzle when the oil pressure is below a threshold value and open the second nozzle and close the first nozzle when the oil pressure is at or above the threshold value; wherein: the internal piston remains in a first position when the oil pressure is below the threshold value and is shifted by the oil pressure to a second position when the oil pressure is at or above the threshold value; when the internal piston is in the first position, the fluid passage supplies oil to the first nozzle; and when the internal piston is in the second position, the fluid passage is blocked off and oil is directed around the internal piston to the second nozzle.

13. The engine according to claim 12, wherein the fluid passage provides a first oil path in fluid communication with the first nozzle and the housing provides a second oil path in fluid communication with the second nozzle.

14. A vehicle comprising:

an internal combustion engine configured to propel the vehicle, the engine including a cylinder defined by a cylinder bore, a piston configured to reciprocate within the cylinder bore, and an oil pump configured to generate oil pressure; and an oil squirter having:

a housing in fluid communication with the oil pump;

a first nozzle in fluid communication with the housing and configured to spray oil onto the cylinder bore;

a second nozzle in fluid communication with the housing and configured to spray oil at the underside of the piston; and a mechanism arranged within the housing and having an internal piston that defines a fluid passage and is configured to open the first nozzle and close the second nozzle when the oil pressure is below a threshold value and open the second nozzle and close the first nozzle when the oil pressure is at or above the threshold value wherein:

the internal piston remains in a first position when the oil pressure is below the threshold value and is shifted by the oil pressure to a second position when the oil pressure is at or above the threshold value;

when the internal piston is in the first position, the fluid passage supplies oil to the first nozzle; and when the internal piston is in the second position, the fluid passage is blocked off.

15. The vehicle according to claim 14, wherein the mechanism additionally includes a spring configured to preload the internal piston to the first position when the oil pressure is below the threshold value and permit the internal piston to be shifted to the second position when the oil pressure is at or above the threshold value; and a stopper configured to substantially block the passage when the internal piston is shifted to the second position.

16. The vehicle according to claim 15, wherein the fluid passage includes a first end and second end, and wherein the first end is exposed to the first nozzle, and the second end is exposed to the oil pump.

17. The engine according to claim 16, wherein the fluid passage provides a first oil path in fluid communication with the first nozzle and the housing provides a second oil path in fluid communication with the second nozzle.

* * * * *